United States Patent [19]

Kubodera et al.

[11] Patent Number: 4,637,975

[45] Date of Patent: Jan. 20, 1987

[54] HEAT-DEVELOPABLE PHOTOGRAPHIC MATERIALS

[75] Inventors: Seiiti Kubodera; Takanori Hioki; Masaki Okazaki, all of Kanagawa, Japan

[73] Assignee: Fuji Photo Film Co., Ltd., Kanagawa, Japan

[21] Appl. No.: 773,163

[22] Filed: Sep. 6, 1985

[30] Foreign Application Priority Data

Sep. 6, 1984 [JP] Japan ..... 59-186855

[51] Int. Cl.[4] ..... G03C 1/02

[52] U.S. Cl. ..... 430/353; 430/592; 430/617; 430/560; 430/203; 430/351; 430/620; 430/619; 430/559; 430/542; 430/561; 430/562

[58] Field of Search ..... 430/592, 593, 203, 617, 430/619, 578, 351, 353, 620, 560, 559, 542, 561, 562

[56] References Cited

U.S. PATENT DOCUMENTS

| | | | |
|---|---|---|---|
| 3,877,943 | 4/1975 | Masuda | 430/578 |
| 3,933,507 | 1/1976 | Von Konig et al. | 430/592 |
| 4,210,715 | 7/1980 | Fujiwhara et al. | 430/593 |
| 4,259,424 | 3/1981 | Endo et al. | 430/617 |
| 4,473,631 | 9/1984 | Hirai et al. | 430/203 |
| 4,524,128 | 6/1985 | Edwards et al. | 430/617 |

FOREIGN PATENT DOCUMENTS 1422057 1/1976 United Kingdom .

OTHER PUBLICATIONS

*Research Disclosure* 17029, Jun. 1978.
*Research Disclosure* 15248 of Dec. 1976.

*Primary Examiner*—Won H. Louie
*Attorney, Agent, or Firm*—Sughrue, Mion, Zinn, Macpeak & Seas

[57] ABSTRACT

A heat-developable photographic material having improved preservability, which comprises a support having thereon at least one heat-developable photgraphic layer, said photographic material containing a dye represented by formula (I)

(I)

wherein $R_1$ and $R_3$ each represents an unsubstituted or substituted alkyl group or alkenyl group;

$R_2$ represents a hydrogen atom or an unsubstituted or substituted alkyl group, aryl group, alkenyl group, or aromatic heterocyclic group;

$R_4$ through $R_7$ each represents a hydrogen atom or an unsubstituted or substituted alkyl group, aryl group, or alkenyl group; or $R_4$ and $R_6$ together form an unsubstituted or substituted alkylene group or alkenylene group;

$X_1$ represents an oxygen atom, a sulfur atom, or the group wherein $R_8$ represents a hydrogen atom, an unsubstituted or substituted alkyl group, aryl group, or alkenyl group;

$Y_1$ represents an atomic group forming an unsubstituted or substituted pyridine or quinoline ring together with nitrogen and carbon atoms represented in formula (I);

$Y_2$ represents an atomic group forming an unsubstituted or substituted heterocyclic ring, together with carbon and nitrogen atoms represented in formula (I);

$X_2$ represents an anion; and $n_1$ represents 0 or 1.

19 Claims, No Drawings

HEAT-DEVELOPABLE PHOTOGRAPHIC MATERIALS

FIELD OF THE INVENTION

The present invention relates to heat-developable photographic materials, and particularly to such materials having improved preservability.

BACKGROUND OF THE INVENTION

Photographic techniques using a silver halide have heretofore been most widely utilized, since the photographic characteristics thereof, such as sensitivity, gradation control, etc., are superior to those of other photographic techniques such as electrophotography or diazo photography. Recently, an improved photographic technique has been developed capable of simply and rapidly forming an image, where the image-formation of a silver halide-containing photographic material is carried out by means of a dry process using heat instead of a conventional wet processing using a developing liquid or the like.

A heat-developable photographic material is known in this technical field, and various heat-developable photographic material and processes thereof are described, for example, in *Bases of Photographic Industry,* Corona Publishing, 1979, pp. 553–555; *Film Information* (April, 1978), p. 40; *Neblette's Handbook of Photography and Reprography,* 7th Ed., Van Nortrand Reinhold Company, 1977, pp. 32–33; U.S. Pat. Nos. 3,152,904, 3,301,678, 3,392,020 and 3,457,075; British Pat. Nos. 1,131,108 and 1,167,777; and *Research Disclosure,* RD No. 17029 (June, 1978), pp. 9–15.

Many processes have been proposed for formation of color images. As for means for formation of color images due to binding of a developing agent, as oxidized, and a coupler, U.S. Pat. No. 3,531,286 describes a combination of a p-phenylene-diamine reducing agent and a phenolic or active methylene-coupler; U.S. Pat. No. 3,761,270 described a p-aminophenol reducing agent; Bergian Pat. No. 802,519 and *Research Disclosure,* RD No. 13742 (September, 1975), pp. 31–32 describe a sulfonamidophenol reducing agent; and U.S. Pat. No. 4,021,240 describes a combination of a sulfonamidophenol reducing agent and a four-equivalent coupler.

Other methods for formation of positive color images include a photographic silver dye-bleaching process, as described, for example, in *Research Disclosure,* RD No. 14433 (April, 1976), pp. 30–32 and RD No. 15227 (December, 1976), pp. 14–15, and U.S. Pat. No. 4,235,957, which disclose useful dyes and bleaching processes.

In addition, European Patent Publication (unexamined) Nos. 76,492 and 79,056 and Japanese Patent Application (OPI) Nos. 28928/83 and 26008/83 disclose a method for formation of color images by heat-development, using a compound essentially having a dye moiety and capable of releasing a mobile dye corresponding or reversely corresponding to the reduction reaction to reduce a silver halide to silver at a high temperature. The term "OPI" indicates an unexamined patent application open to public inspection.

In said image-forming methods, an alkaline agent or an alkali precursor is generally incorporated in a photographic material, in order to accelerate the development of said material under heat. However, such photographic materials as comprising a combination of a silver halide emulsion which has been color-sensitized with a sensitizing dye and an alkaline agent or an alkali precursor have a serious defect in that the sensitivity of the material is usually lowered during the preservation thereof.

In particular, in the case that a color-sensitized silver halide is used in a photographic system containing said dye and a compound capable of releasing a mobile dye corresponding to or reversely corresponding to the reduction reaction or reducing said silver halide to silver at a high temperature, the preservation stability of the material is especially remarkably lowered. The reason is thought to be as follows: As the dye-releasing compound itself has a dye moiety, it thereby has characteristics of a dye, and so, if said dye-releasing compound is co-used together with a silver halide which has been color-sensitized with a sensitizing dye, said dye-releasing compound may react with said sensitizing dye which has adsorbed to the silver halide, resulting in desorption of said sensitizing dye from the surface of the silver halide during preservation (before use) of the photographic material. Such defect can be fatal in color photographic materials or other photographic materials in the case of the electromagnetic radiation falling outside of the range of the intrinsic sensitivity of a silver halide.

SUMMARY OF THE INVENTION

An object of the present invention is to overcome said problems in the prior art, and to provide a heat-developable photographic material of high stability, which can maintain a determined sensitivity during preservation for a long period of time.

The present invention provides a heat-developable photographic material comprising a support having thereon at least one heat-developable photographic layer, said photographic material containing a dye represented by formula (I)

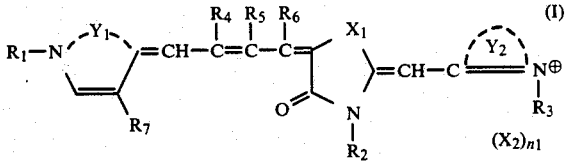

(I)

wherein $R_1$ and $R_3$ each represents an unsubstituted or substituted alkyl group or alkenyl group;

$R_2$ represents a hydrogen atom or an unsubstituted or substituted alkyl group, aryl group, alkenyl group, or aromatic heterocyclic group;

$R_4$ through $R_7$ each represents a hydrogen atom or an unsubstituted or substituted alkyl group, aryl group, or alkenyl group; or $R_4$ and $R_6$ together form an unsubstituted or substituted alkylene group or alkenylene group;

$X_1$ represents an oxygen atom, a sulfur atom, or the group

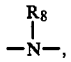

wherein $R_8$ represents a hydrogen atom, an unsubstituted or substituted alkyl group, aryl group, or alkenyl group;

$Y_1$ represents an atomic group forming an unsubstituted or substituted pyridine or quinoline ring, together with nitrogen and carbon atoms represented in formula (I);

$Y_2$ represents an atomic group forming an unsubstituted or substituted heterocyclic ring, together with carbon and nitrogen atoms represented in formula (I);

$X_2$ represents an anion; and $n_1$ represents 0 or 1.

DETAILED DESCRIPTION OF THE INVENTION

Compounds of the present invention, represented by said formula (I), are sensitizing dyes which are sensitive to infrared radiation. Accordingly, the photographic materials of the present invention are especially useful for heat-developable photographic materials having an infrared radiation-sensitive layer.

In particular, said sensitizing dyes of formula (I) are especially useful when used together with a silver halide.

The formula (I) is explained in more detail in the following explanation.

$R_1$ and $R_3$ each represents, for example, an alkyl group (such as a methyl group, an ethyl group, a propyl group, a butyl group or an isobuty group); a substituted alkyl group such as a hydroxyalkyl group (e.g., a hydroxyethyl group, a hydroxymethyl group), a carboxyalkyl group (e.g., a carboxymethyl group, a 3-carboxypropyl group), a sulfoalkyl group (e.g., a sulfopropyl group, a 4-sulfobutyl group), an aminoalkyl group (e.g., a dimethylaminoethyl group), an aralkyl group (e.g., a benzyl group, a p-methylbenzyl group), a cyanoalkyl group (e.g., a cyanoethyl group, a cyanopropyl group) or a carbamoylalkyl group; or an alkenyl group (such as an allyl group).

$R_2$ represents a hydrogen atom, an alkyl group (such as an methyl group, an ethyl group); a substituted alkyl group such as a hydroxyalkyl group (e.g., a hydroxyethyl group), a carboxyalkyl group (e.g., a carboxymethyl group), a sulfoalkyl group (e.g., a sulfopropyl group, a 4-sulfobutyl group), an aminoalkyl group (e.g., a dimethylaminoethyl group), an aralkyl group (e.g., a benzyl group), a cyanoalkyl group (e.g., a cyanoethyl group); an aryl group such as a phenyl group; a substituted aryl group such as a p-carboxymethylphenyl group; an alkenyl group such as an allyl group; an aromatic heterocyclic group such as a 2-pyridyl group.

$R_4$ through $R_7$ each represents, for example, a hydrogen atom; an alkyl group such as a methyl group or an ethyl group; a substituted alkyl group which may optionally have a hetero-atom such as an oxygen atom in the alkyl-carbon chain, such as an alkyl group substituted with a methoxy group or an ethoxy group; an aryl group such as a phenyl group; a substituted aryl group with, e.g., a halogen atom; or an alkenyl group.

$R_4$ and $R_6$ may together form an alkylene or an alkenylene group, which may be linear or branched, and preferably is an alkylene group such as a butylene group, a propylene group, or a tert-pentylene group.

The alkyl and alkenyl moiety in the group represented by $R_1$ through $R_7$ preferably have from 1 to 32 carbon atoms and from 2 to 32 carbon atoms, respectively, and the aryl group and aralkyl group moiety in the group represented by $R_1$ through $R_7$ preferably have from 6 to 32 carbon atoms and from 7 to 32 carbon atoms, respectively.

$Y_1$ represents an atomic group forming a pyridine or quinoline ring, which may optionally be substituted.

$Y_2$ forms a nitrogen-containing heterocyclic ring, typically a 5-membered heterocyclic ring, which may be fused with a benzene ring, etc. For instance, $Y_2$ forms an imidazole, benzimidazole, oxazole, benzoxazole, thiazole, benzothiazole or naphthothiazole ring, which may optionally be substituted. Substituents on said $Y_1$ and $Y_2$ rings include, for example, a halogen atom such as a chlorine atom, a bromine atom, or a fluorine atom; an alkyl group such as a methyl group or an ethyl group; an alkoxy group such as a methoxy group or an ethoxy group; an alkoxycarbonyl group such as methoxycarbonyl group; a hydroxy group; a carboxyl group; a substituted alkyl group such as a trifluoromethyl group; an aryl group such as a phenyl group; and a substituted aryl group. The alkyl moiety and the aryl moiety in the group represented by $Y_2$ preferably have from 1 to 32 carbon atoms and from 6 to 32 carbon atoms, respectively.

$X_1$ represents an oxygen atom, a sulfur atom or a formula $$-\overset{|}{\underset{|}{N}}-R_8;$$

wherein $R_8$ represents, for example, a hydrogen atom, an alkyl group such as a methyl group or an ethyl group; a substituted alkyl group with, e.g., a hydroxy group or a carboxy group, such as a hydroxyethyl group or a carboxyethyl group; an aryl group such as a phenyl group; a substituted aryl group; an alkenyl group such as an allyl group. The alkyl moiety, the aryl moiety, and the alkenyl moiety represented by $R_8$ preferably have from 1 to 32 carbon atoms, from 6 to 32 carbon atoms and from 2 to 32 carbon atoms, respectively.

$X_2$ may be any of an inorganic anion or an organic anion, and represents, for example, a halide ion such as a chloride ion, a bromide ion or a fluoride ion; an alkylsulfonic acid such as a p-methylsulfonic acid ion; a thiocyanic acid ion or a perchloric acid ion. In case the compound of the formula (I) forms an inner salt, said anion is unnecessary.

Examples of sensitizing dyes of the above-described formula (I) are set forth below, which, however, do not restrict the scope of the present invention.

(I)
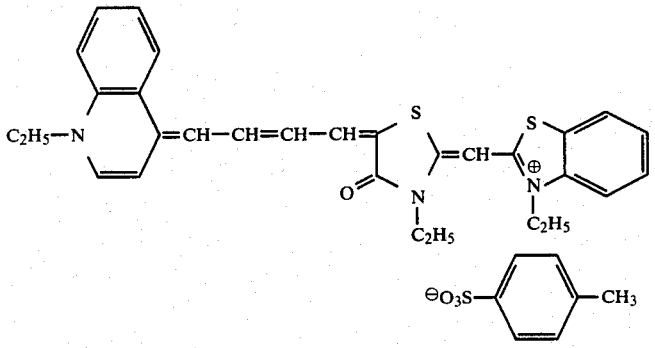
(II)
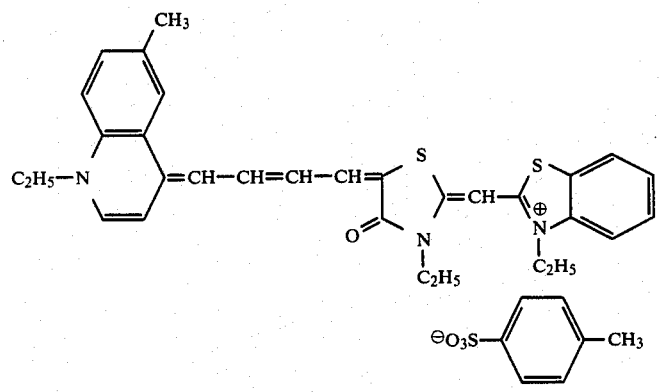
(III)
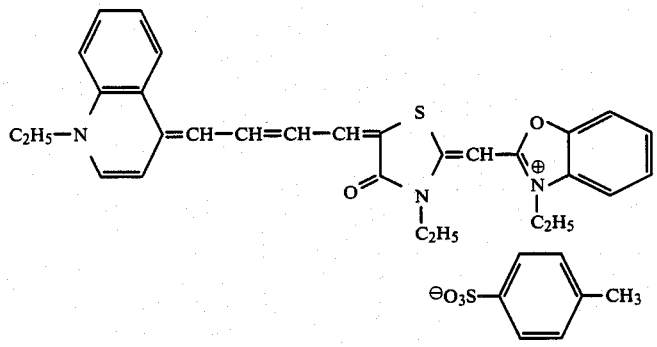
(IV)
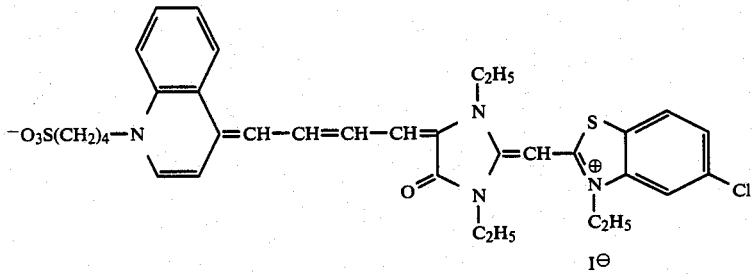

-continued
(V)
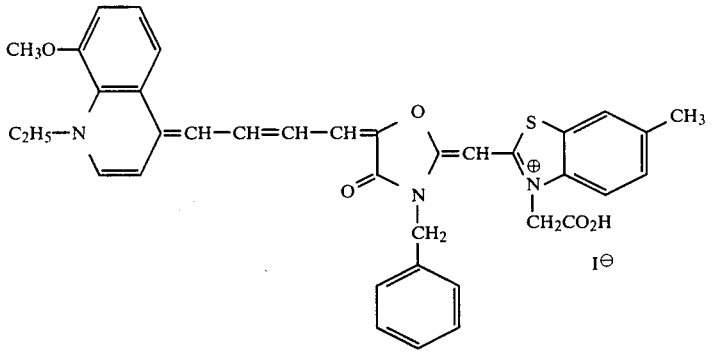
(VI)
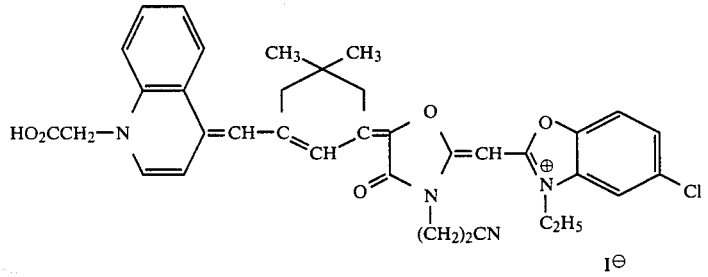
(VII)
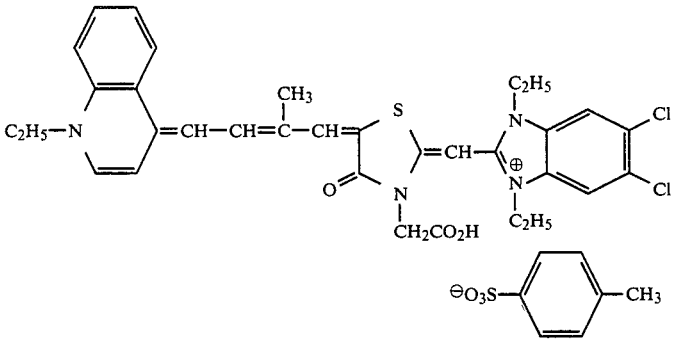
(VIII)
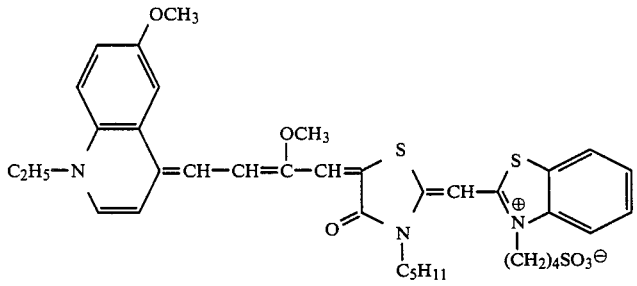
(IX)
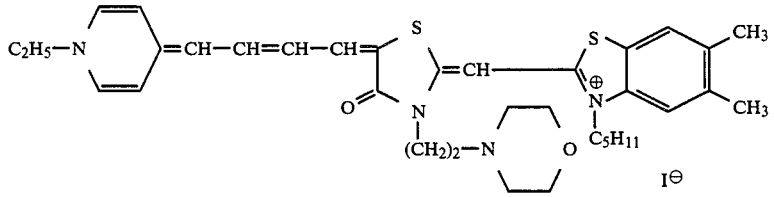

-continued (X)

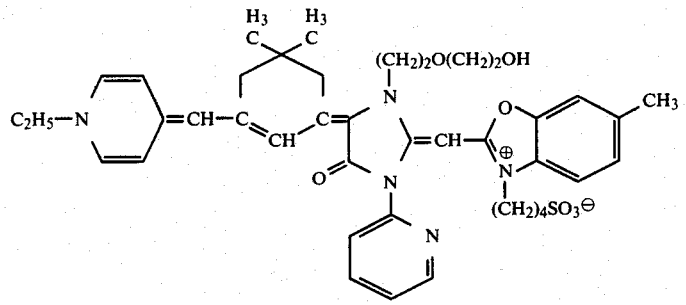

A typical example is set forth below to illustrate the synthesis of the above compounds.

Synthesis of Compound No. (1)

4 g of 1-ethyl-4-acetanilido-butadiene-quinolinium iodide, 2 g of 3-ethyl-rhodanine and 2.6 g of triethylamine were added to 40 ml of methanol and heated under reflux for one hour. The resultant mixture was cooled using water to form a precipitate of 3 g of 3-ethyl-5-[(1-ethyl-4-quinolylidene)butenylidene]rhodanine.

3 g of thus obtained intermediate was heated together with 5 ml of methyl p-toluenesulfonate, at 100° C. for 10 minutes, and ethyl acetate (100 ml) was added to the resultant reaction solution to obtain an oily substance. 3 g of 2-methyl-3-ethylbenzothiazolium p-toluene-sulfonate was added thereto, and the whole was dissolved in 50 ml of acetonitrile. 2 g of triethylamine was added to the reaction solution and stirred for one hour at room temperature. Next, ethyl acetate (200 ml) was added to said reaction solution, and the formed crystals were separated by suction-filtration. The crystals obtained were dissolved in methanol (20 ml) and crystallized with ethyl acetate (200 ml), and then the recrystallized crystals were separated by suction-filtration. Thus, 2 g of said Compound No. (1) was obtained, having a melting point of from 175° to 177° C.

$$\lambda_{max}^{MeOH} = 772 \text{ nm } (\epsilon = 8.84 \times 10^4)$$

Other compounds falling within the scope of formula (I) of the present invention may also be obtained in an analogous manner to that set forth above.

These sensitizing dyes of the present invention may be used singly or may be used in combinations thereof. In addition, the emulsion used in the photographic material of the present invention may contain a dye which does not itself have any spectral-sensitization activity or a substance which does not substantially absorb any visible radiation, but which does have supersensitization activity, together with the sensitizing dye represented by formula (I). For instance, a nitrogen-containing heterocyclic group-substituted aminostilbene compound (e.g., as described in U.S. Pat. Nos. 2,933,390 and 3,635,721), an aromatic organic acid/formaldehyde condensation product (e.g., as described in U.S. Pat. No. 3,743,510), a cadmium salt, an azaindene compound, etc., may be used together with the sensitizing dye of formula (I). The combinations as described in U.S. Pat. Nos. 3,615,613, 3,615,641, 3,617,295, and 3,635,721 are especially preferred.

The amount of the sensitizing dye of the present invention to be used in an emulsion is from $10^{-8}$ to $10^{-2}$ mole, and preferably from $10^{-7}$ to $10^{-4}$ mole, per mole of a silver halide in said emulsion.

The infrared sensitizing dye to be used in the present invention may be directly dispersed in the emulsion. Otherwise, said sensitizing dye is first dissolved in a solvent such as methyl alcohol, ethyl alcohol, methyl cellosolve, acetone, water, pyridine, or a mixed solvent thereof, and the resultant solution may then be added to the emulsion. In some cases, ultrasonic waves may be applied to the dye solution. For the addition of said infrared sensitizing dye, various conventional means may be utilized, including a method wherein a dye is dissolved in a volatile organic solvent and the resultant solution is dispersed in a hydrophilic colloid and the dispersion formed thereby is added to an emulsion, as described in U.S. Pat. No. 3,469,987; a method wherein a water-insoluble dye is, without being dissolved, dispersed in a water-soluble solvent and the resultant dispersion is added to an emulsion, as described in Japanese Patent Publication No. 24185/71; a method wherein a dye is dissolved in a surfactant solution and the resultant solution is added to an emulsion, as described in U.S. Pat. No. 3,822,135; a method where a dye is dissolved using a red-shifting compound and the resultant solution is added to an emulsion, as described in Japanese Patent Application (OPI) No. 74624/76; and a method wherein a dye is dissolved in a substantially water-free acid and the resultant solution is added to an emulsion, as described in Japanese Patent Application (OPI) No. 80826/75. In addition, various known techniques as described in U.S. Pat. Nos. 2,912,343, 3,342,605, 2,996,287, 3,429,835, etc., may be applied to the addition of the sensitizing dye to a photographic emulsion. In this connection, said infrared-sensitizing dye may be uniformly dispersed in a silver halide emulsion, before being coated on a pertinent support, and it is of course convenient that said dye may be added to said silver halide emulsion in any step of the preparation of said emulsion. For instance, said dye may be incorporated during the formation of said silver halide particles, or otherwise may be incorporated during the after-ripening of said emulsion.

The photographic material of the present invention may also have, if desired, one or more layers having a photo-sensitivity in any spectral range other than the infrared-spectral range, in addition to the infrared-sensitive layer.

The sensitizing dye of the present invention is especially effective when used together with a base or a base precursor.

Examples of preferred bases which may be used in the present invention are inorganic bases such as alkali metal or alkaline earth metal hydroxides, secondary or tertiary phosphates, borates, carbonates, metaborates;

ammonium hydroxides; and other metal hydroxides; and organic bases such as quaternary alkylammonium hydroxides; quinolinates; aliphatic amines (e.g., trialkylamines, hydroxylamines, aliphatic polyamines); aromatic amines (e.g., N-alkyl-substituted aromatic amines, N-hydroxyalkyl-substituted aromatic amines and bis[p-(dialkylamino)phenyl]methanes); heterocyclic amines, amidines, cyclic amidines, guanidines, cyclic guanidines, etc. Among them, those having a pKa value of 8 or more are especially preferred.

As a base precursor, those capable of releasing a base through some reaction under heat are preferably used, including a salt of an organic acid and a base capable of decarboxylating and decomposing under heat or a compound capable of decomposing and releasing an amine due to intramolecular nucleophilic substitution-reaction, Lossen rearrangement, Beckmann rearrangement or the like reaction. Examples of preferred base precurosrs are salts of trichloro-acetic acid, as described in British Pat. No. 998,949; salts of α-sulfonyl-acetic acid, as described in U.S. Pat. No. 4,060,420; salts of propiolic acids, as described in Japanese Patent Application (OPI) No. 180537/84; 2-carboxy-carboxamide derivatives, as described in U.S. Pat. No. 4,088,496; salts of pyrolytic acids, in which as alkali metal or alkaline earth metal component is used besides an organic base, as a base component, as described in Japanese Patent Application (OPI) No. 195237/84; hydroxame-carbamates as described in Japanese Patent Application (OPI) No. 168440/84, in which a Lossen rearrangement is utilized; aldoxime-carbamates capable of forming a nitrile under heat, as described in Japanese Patent Application (OPI) No. 157637/84, etc. In addition, other base precursors as described in British Pat. No. 998,945, U.S. Pat. No. 3,220,846, Japanese Patent Application (OPI) No. 22,625 and British Pat. No. 2,079,480 are also useful.

Particularly useful base precursors which are especially preferred in the present invention are guanidine trichloro-acetate, methylguanidine trichloro-acetate, potassium trichloro-acetate, guanidine phenylsulfonyl-acetate, guanidine p-chlorophenylsulfonyl-acetate, guanidine p-methanesulfonylphenylsulfonyl-acetate, potassium phenyl-propiolate, cesium phenyl-propiolate, guanidine phenyl-propiolate, guanidine p-chlorophenyl-propiolate, quanidine 2,4-dichlorophenyl-propiolate, diguanidine p-phenylene-bis-propiolate, tetramethylammonium pheynlsulfonyl-acetate, tetramethylammonium phenyl-propiolate, etc.

The range of the amount of said base or base precursor to be used may be wide. The useful range thereof is not more than 50 wt% on the basis of the total weight of a coated and dried layer(s) of a photographic material, and more preferably is from 0.01 wt% to 40 wt%.

The base or base precursor may be incorporated in any photographic layer of the photographic material of the present invention. For example, it may be included in a silver halide emulsion layer, an interlayer, a protective layer, an image receiving layer, etc.

According to the present invention, silver can be utilized as an image forming substance. Further, various other image forming substances can be employed in various image forming processes.

For instance, couplers capable of forming color images upon reaction with an oxidation product of a developing agent which are used in liquid development processing widely known hitherto can be employed. For example, as magenta couplers, there are 5-pyrazolone couplers, pyrazolobenzimidazole couplers, cyanoacetylcoumarone couplers and open chain acylacetonitrile couplers, etc. As yellow couplers, there are acylacetamide couplers (for example, benzoylacetanilides and pivaloyl-acetanilides), etc. As cyan couplers, there are naphthol couplers and phenol couplers, etc. It is preferred that these couplers be nondiffusible substances which have a hydrophobic group called a ballast group in the molecule thereof or be polymerized substances. The couplers may be any of the 4-equivalent type and 2-equivalent type to silver ions. Further, they may be colored couplers having a color correction effect or couplers which release a development inhibitor at development processing (so-called DIR couplers).

Further, dyes for forming positive color images by a light-sensitive silver dye bleach processes, for example, those as described in *Research Disclosure,* RD No. 14433 (April, 1976), pp. 30–32, ibid., RD No. 15227 (December, 1976), pp. 14–15, and U.S. Pat. No. 4,235,957, etc., can be employed.

Moreover, leuco dyes as described, for example, in U.S. Pat. Nos. 3,985,565 and 4,022,617, etc., can be used.

Further, dyes to which a nitrogen-containing heterocyclic group have been introduced as described in *Research Disclosure,* RD No. 16966 (May, 1978), pp. 54–58, may be employed.

In addition, dye providing substances which release a mobile dye by utilizing a coupling reaction of a reducing agent oxidized by an oxidation reduction reaction with a silver halide or an organic silver salt at high temperature as described in European Pat. No. 79,056, West German Pat. No. 3,217,853, European Pat. No. 67,455, etc., and dye providing substances which release a mobile dye as a result of an oxidation reduction reaction with a silver halide or an organic silver salt at high temperature as described in European Pat. No. 76,942, West German Pat. No. 3,215,485, European Pat. No. 66,282, Japanese Patent Application (OPI) No. 154,445/84 and U.S. Pat. No. 4,503,137, etc., can be employed.

Preferred dye providing substances which can be employed in these processes can be represented by formula (CI)

$$(\text{Dye-X})_q\text{Y} \qquad \text{(CI)}$$

wherein Dye represents a dye which becomes mobile when it is released from the molecule of the compound represented by formula (CI); X represents a chemical bond or a linking group; Y represents a group which releases Dye in correspondence or counter-correspondence to light-sensitive silver salts having a latent image distributed imagewise, the diffusibility of Dye released being different from that of the compound represented by formula (CI), q represents an integer of 1 or 2, and when q is 2, the two (Dye-X) are the same or different.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes, and phthalocyanine dyes, etc. These dyes can also be used in the form of having temporarily shorter wavelengths, the color of which is recoverable in the development processing.

More specifically, the dyes as described in European Pat. No. 76,492 can be utilized.

Examples of the connecting group represented by X include —NR— (wherein R represents a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (CI) are described in greater detail.

In one embodiment, Y is selected so that the compound represented by formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

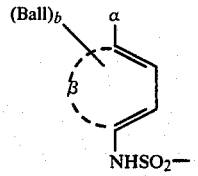

(CII)

wherein $\beta$ represents non-metallic atoms necessary for forming a benzene ring, which may optionally be fused with a carbocyclic ring or a heterocyclic ring to form, for example, a naphthalene ring, a quinoline ring, a 5,6,7,8-tetrahydronaphthalene ring, a chroman ring or the like;

$\alpha$ represents a group of —$OG^{11}$ or —$NHG^{12}$ (wherein $G^{11}$ represents hydrogen or a group which forms a hydroxyl group upon being hydrolyzed, and $G^{12}$ represents hydrogen, an alkyl group containing from 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other examples of Y suited for this type of compound are those represented by formula (CIII)

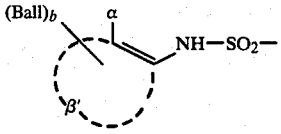

(CIII)

wherein Ball, $\alpha$ and $\beta$ are the same as defined in formula (CII), $\beta'$ represents atoms necessary for forming a carbocyclic ring (e.g., a benzene ring which may be fused with another carbocyclic ring or a heterocyclic ring to form, e.g., a naphthalene ring, a quinoline ring, a 5,6,7,8-tetrahydronaphthalene ring, a chroman ring, or the like). Specific examples of this type of Y are described in Japanese Patent Application (OPI) Nos. 113624/76, 12642/81, 16130/81, 4043/82 and 650/82 and U.S. Pat. No. 4,053,312.

Further examples of Y suited for this type of compound are those represented by formula (CIV)

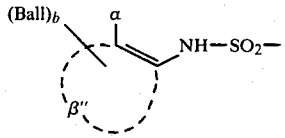

(CIV)

wherein Ball, $\alpha$ and $\beta$ are the same as defined in formula (CII), and $\beta''$ represents atoms necessary for forming a heterocyclic ring such as a pyrazole ring, a pyridine ring or the like, said heterocyclic ring being optionally bound to a carbocyclic ring or a heterocyclic ring. Specific examples of this type of Y are described in Japanese Patent Application (OPI) No. 104343/76.

Still further examples of Y suited for this type of compound are those represented by formula (CV)

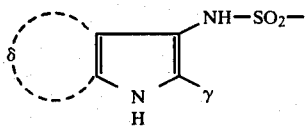

(CV)

wherein $\gamma$ preferably represents hydrogen, a substituted or unsubstituted alkyl, aryl or heterocyclic group, or —CO—$G^{21}$; $G^{21}$ represents —$OG^{22}$, —$SG^{22}$ or

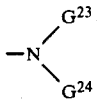

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a fused benzene ring.

Specific examples of this type of Y are described in Japanese Patent Application (OPI) Nos. 104343/76, 46730/78, 130122/79 and 85055/82.

Still further examples of Y suited for this type of compound are those represented by formula (CVI)

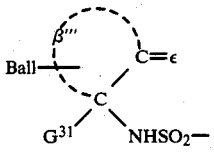

(CVI)

wherein Ball is the same as defined in formula (CII); $\epsilon$ represents an oxygen atom or =$NG^{32}$ (wherein $G^{32}$ represents hydroxyl or an optionally substituted amino group) (examples of $H_2N$—$G^{32}$ to be used for forming the group of =$NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73 and 39165/73, Japanese Patent Application (OPI) No. 64436/74, U.S. Pat. No. 3,443,934, etc.

Still further examples of Y are those represented by formula (CVII)

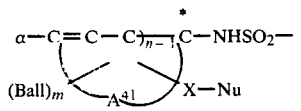

(CVII)

wherein $\alpha$ represents $OR^{41}$ or $NHR^{42}$; $R^{41}$ represents hydrogen or a hydrolyzable component; $R^{42}$ represents hydrogen, or an alkyl group containing from 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having from 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined in the above described formula (CII). Specific examples of this type of Y are described in Japanese Patent Application (OPI) No. 20735/82.

As still further type of examples represented by formula (CI), there are dye providing nondiffusible substances which release a diffusible dye in the presence of a base as a result of self cyclization or the like but which, when reacted with an oxidation product of a developing agent, substantially never release the dye.

Examples of Y effective for this type of compound are those which are represented by formula (CVIII)

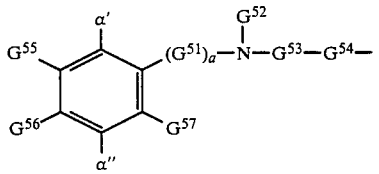

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having from 1 to 3 carbon atoms;

a represents 0 or 1;

$G^{52}$ represents a substituted or unsubstituted alkyl group having from 1 to 40 carbon atoms or a substituted or unsubstituted aryl group having from 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having from 1 to 10 carbon atoms or an aromatic residue having from 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having from 1 to 40 carbon atoms or an optional group defined for $G^{52}$, $G^{55}$ and $G^{56}$ may form a 5- to 7-membered ring, and $G^{56}$ may represent

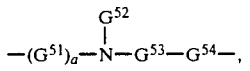

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by formulae (CIX) and (CX)

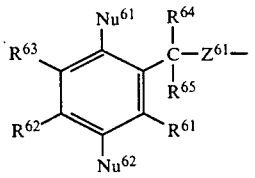

(CIX)

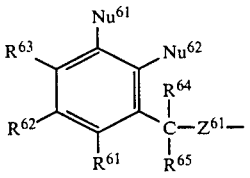

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by formula (CXI)

(CXI)

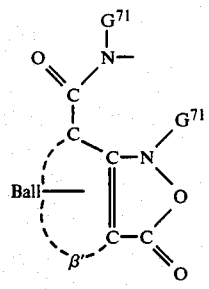

wherein Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by formula (CXII)

(CXII)

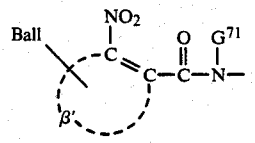

wherein Ball and $B\beta$ are the same as defined for those in formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by formula (CXIII)

(CXIII)

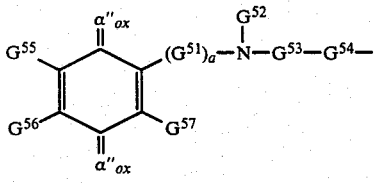

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$ $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by formulae (CXIV-A) and (CXIV-B):

(CXIV-A)

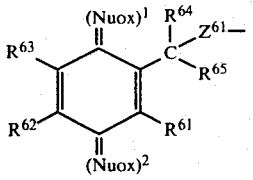

(CXIV-B)

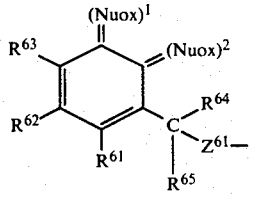

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to formulae (CXII), (CXIII), (CXIV-A) and (CXIV-B) describe electron donors to be used in combination.

As still further different type of compound represented by formula (CI), there are illustrated LDA compounds (Linked Donor Acceptor Compounds). These compounds are dye providing non-diffusible substances which cause donor-acceptor reaction in the presence of a base to release a diffusible dye but, upon reaction with an oxidation product of a developing agent, they substantially do not release the dye any more.

Examples of Y effective for this type of compound are those represented by formula (CXV) (specific examples thereof being described in Japanese Patent Application (OPI) No. 60289/83):

(CXV)

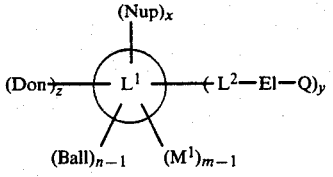

wherein n, x, y and z each represents 1 or 2, m represents an integer of 1 or more; Don represents a group containing an electron donor or its precursor moiety; $L^1$ represents an organic group linking Nup to —$L^2$—El—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance non-diffusible, and is preferably a group containing a $C_{8-32}$ hydrophobic group. Such organic ballast group is bound to the dye providing substance directly or through a linking group (e.g., an imino bond, an ether bond, a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case, two or more kinds of the dye providing substances may be used together in order to provide the same hue or in order to reproduce black color.

The dye providing redox compound used in the present invention can be introduced into a layer of the light-sensitive material by known methods such as the method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of from about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used.

In the present invention, if necessary, a reducing agent may be used. The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* RD No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* RD No. 17029, Japanese Patent Application (OPI) Nos. 32923/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonyl-acetate as an acid part such as bis(2-amino-2-thiazolium)-methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above described bases or base precursors can be used not only for the acceleration of dye release but also for other purposes such as the control of a pH value.

The above described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage to some cases.

The heat developable photosensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by image-wise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes, etc.

In the present invention, after the heat developable color photographic material is exposed to light, the resulting latent image can be developed by heating the whole material to a suitably elevated temperatures. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, stytyl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a super-sensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinyl-sulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization of microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants, and so on, are those described in U.S. Pat. Nos. 4,500,626, 4,478,927, 4,463,079, and Japanese Patent Application (OPI) No. 154,445/84 (corresponding to U.S. patent application Ser. No. 582,655, filed on Feb. 23, 1984) and U.S. Pat. No. 4,503,137. Methods for the exposure, and so on, cited in the above described patents can be employed in the present invention also.

The present invention will be explained in greater detail by reference to the following examples, which, however, are not intended to be interpreted as limiting the scope of the present invention.

EXAMPLE 1

A silver benzotriazole emulsion was prepared as follows:

28 g of gelatin and 13.2 g of benzotriazole were dissolved in 3000 ml of water. The solution formed was kept at 40° C. and stirred. A solution of 17 g of silver nitrate dissolved in 100 ml of water was added to said solution over the course of 2 minutes.

The pH value of this silver benzotriazole emulsion was regulated and sedimented, to remove the excess salt therefrom. Afterwards, the pH value thereof was adjusted to 6.30, to obtain 400 g of the desired silver benzotriazole emulsion.

Next, a silver halide emulsion (A) was prepared as follows:

600 ml of an aqueous solution containing 0.11 mole of sodium chloride and 0.48 mole of potassium bromide and a silver nitrate aqueous solution (containing 0.59 mole of silver nitrate dissolved in 600 ml of water) were simultaneously added to a well-stirred gelatin-aqueous solution (containing 20 g of gelatin and 3 g of sodium chloride dissolved in 1000 ml of water and warmed at 75° C.), in the course of 40 minutes, at the same addition-flow rate. Thus, a mono-dispersed cubic silver bromochloride emulsion (bromine content: 80 mole%) having an average grain size of 0.35 μm was obtained.

After washed with water and demineralized, 5 mg of sodium thiosulfate and 20 mg of 4-hydroxy-6-methyl-1,3,3a,7-tetrazaindene were added to the emulsion obtained and heated at 60° C. for chemical sensitization thereof.

The yield of the emulsion was 600 g.

Next, a gelatin-dispersion of a dye-forming substance was prepared as follows:

5 g of a cyan-dye-forming substance (A) (as given hereinafter), 0.5 g of 2-ethylhexyl succinate/sodium sulfonate (as surfactant) and 10 g of tri-isononyl phosphate were weigted, and 30 ml of ethyl acetate was added thereto and heated at about 60° C. and dissolved, to obtain a uniform solution. The resultant solution was blended with 100 g of 10%-solution of a lime-treated gelatin, while stirred, and then dispersed in a homogenizer for 10 minutes (10,000 rpm) to obtain a cyan-dye-forming substance dispersion.

(A)

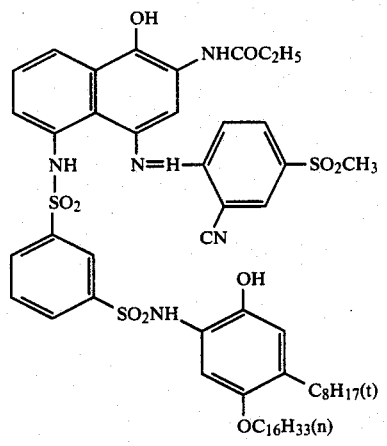

Next, a photographic coating composition (A) was prepared as follows:

| | | |
|---|---|---|
| (a) | Silver benzotriazol emulsion | 10 g |
| (b) | Photographic silver bromochloride emulsion (A) | 15 g |
| (c) | Dispersion of dye-forming substance | 25 g |
| (d) | 5%-aqueous solution of the following compound: | 5 ml |

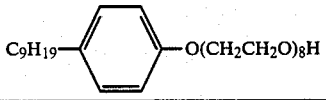

(e) 10%-methanol solution of benzenesulfonamide: 5 ml
(f) 10%-aqueous solution of guanidine 4-methylsulfonyl-phenylsulfonyl-acetate: 15 ml
(g) 0.04%-methanol solution of the above-described sensitizing dye (II): 4 ml The above components (a) through (g) were blended, and a tackfier and water were added thereto to make 100 ml in all. The resultant solution was coated on a polyethylene terephthalate film having a thickness of 180 μm, to form a coat-film having a wet film thickness of 50 μm.

Next, a coating composition for a protective layer was prepared as follows:

Coating composition for protective layer:
(h) 10%-gelatin aqueous solution: 400 g
(i) 10%-aqueous solution of guanidine 4-methylsulfonyl-phenylsulfonyl-acetate: 240 ml
(j) 4%-aqueous solution of a hardener of the following formula:

$CH_2{=}CH{-}SO_2CH_2CONH{-}(CH_2)_2{-}NHCOCH{-}{}_2SO_2CH{=}CH_2$ 50 ml

The above components (h) through (j) were blended, and a tackifier and water were added thereto to make 1000 ml in all.

The obtained coating composition was supercoated on the above formed film coated with the photographic coating composition to form a protective layer having a thickness of 30 μm.

Thus formed sample was dried, and then imagewise exposed to a tungsten lamp of 2000 luxes, through SC-72 Filter (trademark for product manufactured by Fuji Photo Film Co., Ltd.), for one second.

Afterwards, the thus exposed sample was uniformly heated on a heat block heated at 140° C. for 30 seconds.

Next, a dye-fixing material was prepared as follows: 10 g of poly(methyl acrylate-co-N,N,N-trimethyl-N-vinylbenzylammonium chloride) (molar ratio of methyl acrylate to vinylbenzylammoinum chloride=1/1) was dissolved in 200 ml of water, and the resultant solution was uniformly blended with 100 g of 10%-lime-treated gelatin aqueous solution. The formed mixture solution was uniformly coated on a paper support laminated with a titanium dioxide-dispersed polyethylene, to form a coated film having a wet film thickness of 90 μm. Thus formed sample was dried, and used as a dye-fixing material having a mordanting layer.

Next, water was applied to the surface of the coated layer of said dye-fixing material, in an amount of 20 ml/m$^2$, and then the above-exposed photographic material, after being heated, was superposed thereto so that the both surfaces of the coated films of both sheets faced to each other.

The thus superposed sample was heated on a heat-block at 80° C. for 6 seconds, and thereafter the dye-fixing material was peeled off from the photographic material, whereby a cyan-image was formed on said dye-fixing material. The density of the formed image was measured by the use of Macbeth Reflection Densitometer (RD-519). The result is given in the following Table.

TABLE 1

| | Maximum density | Minimum density | γ |
|---|---|---|---|
| Cyan image | 1.8 | 0.11 | 2.6 |

(γ: Density difference between a density ata definite exposure and a density at an exposure10 times the definite exposure in a linear partin the exposure - density graph.)

The above sample was preserved for one day at 50° C., and the antilogarithmic number of the density thereof was 97, that of a fresh sample being 100. It is apparent therefrom that the preservation stability of the present sample is extremely good, as the sensitivity thereof scarecely decreased even when being exposed and developed after preservation.

EXAMPLE 2

In the same manner as in the above Example 1, with the exception that other sensitizers (III), (IV), (VIII), and (X) were used, respectively, instead of the sensitizer (II), photographic samples (B) through (E) were formed. These samples were treated analogously to said Example 1, and the results obtained are shown below.

TABLE 2

| Sample No. | Sensitizing dye | Maximum density | Minimum density | γ | Change of sensitivity after reservation for one day at 50° C. |
|---|---|---|---|---|---|
| B | (III) | 1.8 | 0.12 | 2.4 | −0.02 |
| C | (IV) | 1.7 | 0.14 | 2.2 | −0.05 |
| D | (VIII) | 1.5 | 0.11 | 2.3 | −0.02 |
| E | (X) | 1.6 | 0.16 | 1.9 | −0.03 |

(γ is defined as in Example 1)

The above results prove that the sensitizing dyes of the present invention are advantageous as being almost free from deterioration of the sensitivity thereof during preservation.

EXAMPLE 3

24 g of gelatin, 1 g of potassium bromide and 10 cc of 25%-aqueous ammonia were dissolved in one liter of water to form a Solution-I. This solution was kept at 50° C. and stirred. Next, Solution-a comprising 100 g of silver nitrate dissolved in one liter of water and Solution-b comprising 63 g of potassium bromide and 12 g of potassium iodide dissolved in one liter of water and Solution-c comprising 0.02 g of a sensitizing dye (I) dissolved in 300 cc of methanol were simultaneously added to said Solution-I, in the course of 50 minutes, to obtain a silver bromoiodide emulsion (B).

In the same manner as in the above Example 1, with the exception that 15 g of the above obtained emulsion (B) was used instead of 15 g of the emulsion (A) used in the Example 1, photographic sample (F) was formed, which was treated analogously to said Example 1. The results are set forth below.

TABLE 3

| Sample | Maximum density | Minimum density | γ |
|---|---|---|---|
| F | 1.53 | 0.20 | 2.0 |

(γ is defined as in Example 1.)

EXAMPLE 4

In the same manner as in Example 1 using the sensitizing dye (I), a phtographic sample (G) was formed. Apart from this, another photographic sample (a) (comparative sample) was formed, using a sensitizing dye (a) shown below, for comparison. Photographic characteristics of these samples (fresh samples and samples after being preserved for one day at 50° C.) were tested, and the results are given below. These results prove that the present samples are superior to the other comparative samples. Sensitizing dye (a)

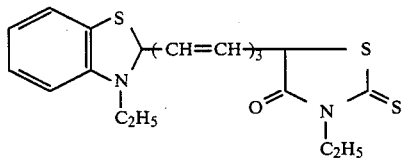

| | Fresh sample | | After preservation for 2 days at 50° C. | |
|---|---|---|---|---|
| Sample No. | Relative sensitivity | Fog | Relative sensitivity | Fog |
| G | 100 | 0.14 | 89 | 1.18 |
| a | 83 | 0.14 | 46 | 0.22 |

The relative sensitivity given in the above table is designated by an antilogarithmic number on the basis of the sensitivity of a fresh sample (G) which is 100.

While the invention has been described in detail and with reference to specific embodiments thereof, it will be apparent to one skilled in the art that various changes and modifications can be made therein without departing from the spirit and scope thereof.

What is claimed is:

1. A heat-developable photographic material comprising a support having thereon at least one heat-developable photographic layer containing a light-sensitive silver halide sensitized by an infra-red sensitizing dye represented by formula (I)

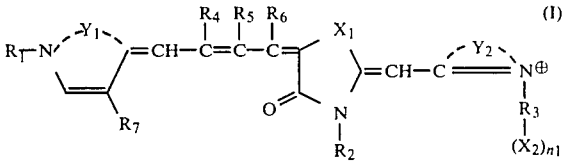

(I)

wherein $R_1$ and $R_3$ each represents an unsubstituted or substituted alkyl group or alkenyl group;

$R_2$ represents a hydrogen atom or an unsubstituted or substituted alkyl group, aryl group, alkenyl group, or aromatic heterocyclic group;

$R_4$ through $R_7$ each represents a hydrogen atom or an unsubstituted or substituted alkyl group, aryl group, or alkenyl group; or $R_4$ and $R_6$ together form an unsubstituted or substituted alkylene group or alkenylene group;

$X_1$ represents an oxygen atom, a sulfur atom, or the group

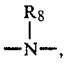

wherein $R_8$ represents a hydrogen atom, an unsubstituted or substituted alkyl group, aryl group, or alkenyl group;

$Y_1$ represents an atomic group forming an unsubstituted or substituted pyridine or quinoline ring together with nitrogen and carbon atoms represented in formula (I);

$Y_2$ represents an atomic group forming an unsubstituted or substituted heterocyclic ring, together with carbon and nitrogen atoms represented in formula (I);

$X_2$ represents an anion; and $n_1$ represents 0 or 1.

2. A heat-developable photographic material as in claim 1, wherein $R_1$ and $R_3$ each represents an unsubstituted alkyl group, a hydroxyalkyl group, a carboxyalkyl group, a sulfoalkyl group, an aminoalkyl group, an aralkyl group, a cyanoalkyl group, a carbamoylalkyl group, or an alkenyl group.

3. A heat-developable photographic material as in claim 1, wherein $R_2$ represents a hydrogen atom or an unsubstituted alkyl group, a hydroxyalkyl group, a carboxyalkyl group, a sulfoalkyl group, an amino alkyl group, an aralkyl group, a cyanoalkyl group, an aryl group, a substituted aryl group, an alkenyl group, or an aromatic heterocyclic group.

4. A heat-developable photographic material as in claim 1, wherein $R_4$ through $R_7$ each represents a hydrogen atom, an unsubstituted alkyl group, a substituted alkyl group having a hetero-atom in the alkyl-carbon chain, an aryl group, a substituted aryl group, or an unsubstituted alkenyl group; or $R_4$ and $R_6$ together form an alkylene or alkenylene group.

5. A heat-developable photographic material for heat-development as in claim 1, where $Y_1$ forms a pyridine or quinoline ring substituted by at least one substituent selected from the group consisting of a halogen atom, an alkyl group, an alkoxy group, an alkoxycarbonyl group, a hydroxyl group, a carboxyl group, a substituted alkyl group, an aryl group, and a substituted aryl group.

6. A heat-developable photographic material as in claim 1, wherein $Y_2$ forms a 5-membered heterocyclic ring.

7. A heat-developable photographic material as in claim 1, wherein $Y_2$ forms a 5-membered heterocyclic ring fused with a benzene ring.

8. A heat-developable photographic material as in claim 1, wherein $Y_2$ forms an unsubstituted or substituted imidazole ring, benzimidazole ring, oxazole ring, benzoxazole ring, thiazole ring, benzothiazole ring, or naphthothiazole ring, wherein said substituent is at least one member selected from the group consisting of a halogen atom, an unsubstituted alkyl group, an alkoxy group, an alkoxycarbonyl group, a hydroxyl group, a carboxyl group, a substituted alkyl group, an unsubstituted aryl group, and a substituted aryl group.

9. A heat-developable photographic material as in claim 1, wherein $X_2$ represents a halide ion, an alkylsulfonic acid ion, a thiocyanic acid ion or a perchloric acid ion.

10. A heat-developable photographic material as in claim 1, wherein said photographic material contains a base or a base precursor.

11. A heat-developable photographic material as in claim 10, wherein the amount of said base or base precursor is not more than 50 wt% based on the total weight of coated layer(s) of the photographic material.

12. A heat-developable photographic material as in claim 10, wherein the amount of said base or base precursor is from 0.01 to 40 wt% based on the total weight of coated layer(s) of the photographic material.

13. A heat-developable photographic material as in claim 1, wherein said photographic material contains a dye-forming substance.

14. A heat-developable photographic material as in claim 13, wherein said dye-forming substance is selected from the group consisting of a coupler, a dye to which a nitrogen-containing heterocyclic group have been introduced, dye which is used in a silver dye bleach process for heat-development, a leuco dye, and a dye-forming substance capable of imagewise releasing a diffusive dye.

15. A heat-developable photographic material as in claim 14, wherein said dye-forming substance capable of imagewise releasing a diffusive dye is represented by formula (CI)

$$\text{(Dye-X)—Y} \qquad \text{(CI)}$$

wherein Dye represents a dye which becomes mobile when it is released from the molecule of the compound represented by formula (CI); X represents a chemical bond or a linking group; Y represents a group which releases Dye in correspondence or counter-correspondence to light-sensitive silver salts having a latent image distributed imagewise, the diffusibility of Dye released being different from that of the compound represented by formula (CI), q is an integer of 1 or 2, and when q is 2, the two (Dye-X) are the same or different.

16. A method for producing an image, which comprises heat developing an imagewise exposed heat developable photographic material comprising a support having thereon at least one heat developable photographic layer containing a light-sensitive silver halide sensitized by an infra-red sensitizing dye represented by formula (I)

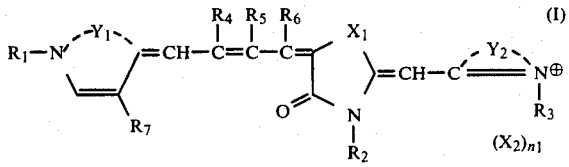

(I)

wherein $R_1$ and $R_3$ each represents an unsubsituted or substituted alkyl group or alkenyl group;

$R_2$ represents a hydrogen atom or an unsubstituted or substituted alkyl group, aryl group, alkenyl group, or aromatic heterocyclic group;

$R_4$ through $R_7$ each represents a hydrogen atom or an unsubstituted or substituted alkyl group, aryl group or an alkenyl group; or $R_4$ and $R_6$ together form an unsubstituted or substituted alkylene group or alkenylene group;

$X_1$ represents an oxygen atom, a sulfur atom or a group $$-\overset{\overset{R_8}{|}}{N}-,$$

wherein $R_8$ represents a hydrogen atom or an unsubstituted or substituted alkyl group, aryl group, alkenyl group;

$Y_1$ represents an atomic group forming an unsubstituted or substituted pyridine or quinoline ring together with nitrogen and carbon atoms represented in formula (I);

$Y_2$ represents an atomic group forming an unsubstituted or substituted heterocyclic ring, together with carbon and nitrogen atoms represented in formula (I);

$X_2$ represents an anion; and $n_1$ represents 0 or 1.

17. A heat-developable photographic material as in claim 1, wherein said photographic material contains a reducing agent.

18. A heat-developable photographic material as in claim 1, wherein the amount of said dye of the formula (I) is from $10^{-8}$ to $10^{-2}$ mole per mole of a silver halide.

19. A heat-developable photographic material as in claim 17, wherein said reducing agent is a dye-forming substance.

* * * * *